United States Patent [19]

Charpentier et al.

[11] Patent Number: 4,465,541

[45] Date of Patent: Aug. 14, 1984

[54] GROUPING SINGLE DOSE CONTAINERS

[75] Inventors: Gérard J. Charpentier, Landes; Francis Cazas, Val-de-Marne, both of France

[73] Assignees: Etablissements Cazas, Seine-Saint-Denis; Monoplast, Landes, both of France

[21] Appl. No.: 340,029

[22] Filed: Jan. 18, 1982

[30] Foreign Application Priority Data

Jan. 19, 1981 [FR] France ..... 81 00878

[51] Int. Cl.[3] ..... B29C 27/06; B29C 27/08; B29C 27/10

[52] U.S. Cl. ..... 156/304.1; 156/73.1; 156/304.6; 156/559; 156/567; 156/571; 156/580.1

[58] Field of Search ..... 156/73.1, 304.1, 304.6, 156/559, 567, 571, 556, 580.1; 53/443, 147, 153, 154, 158

[56] References Cited

U.S. PATENT DOCUMENTS

| | | | |
|---|---|---|---|
| 3,700,530 | 10/1972 | Ehe | 156/559 |
| 4,310,366 | 1/1982 | Van Manen | 156/567 |
| 4,310,377 | 1/1982 | Lorenz | 156/567 |

FOREIGN PATENT DOCUMENTS 1248537 8/1967 Fed. Rep. of Germany .

*Primary Examiner*—Michael G. Wityshyn
*Attorney, Agent, or Firm*—J. David Dainow

[57] ABSTRACT

An apparatus for grouping unitary dose containers which have polygonal collars receives such containers from a supply magazine and directs them by a first transfer device onto mandrels on plates carried by a rotating drum. The containers are carried by the drum to a second station where heads of a joining device join adjacent edges of collars of selected containers. Subsequently, the drum is further rotated for carrying the joined containers to another station where a second transfer device transfers the joined containers onto a receiving device.

11 Claims, 8 Drawing Figures

54
52
50
96
92
94
94
10
98
28
100
106
28
B
28
C
A
D
18
84
83
80
66
78
82
74
72b
72c
10
56
58
60
108
118
112
114
110
112
116
120
112

GROUPING SINGLE DOSE CONTAINERS

BACKGROUND OF THE INVENTION

This invention relates to grouping single dose containers, the containers being intended, for example, to contain dairy products such as yoghurt or the like.

French Patent Specification No. 7823468 describes a process for grouping unitary dose containers together, each container being terminated at its upper edge by a collar or flange the exterior contour of which is polygonal, the process comprising the assembly of two sides edge to edge using one part of the two collars as a reserve of material. This Patent Specification also describes the formation of lips at the edge of the collars. This process is such that assembly can be effected by heat and pressure, ultrasonic welding or by means of an adhesive.

Such a process is particularly advantageous since it permits grouping of unitary containers into twos, threes, fours or sixes, for example, the containers being able to carry printing around the whole of their periphery. In this way the combined grouping can be provided with very attractive decoration which gives very good visual impact.

SUMMARY OF THE INVENTION

The present invention relates to apparatus for grouping unitary dose containers which puts the process described in the above-noted French Patent Specification into practice, as well as being directed to a process which constitutes an improvement of that described in that Patent Specification.

More particularly the invention relates to apparatus and a process for grouping unitary dose containers involving the transfer of the individual containers from a stock to a support plate, displacement of this plate to face a grouping device, grouping together of at least some of the containers, then if desired displacement and marking of the containers and finally displacement of the plate carrying the containers and the transfer of the latter on to a stock or a conveyor, for example of a packaging machine.

More specifically the invention relates to apparatus for grouping unitary dose containers each provided with a polygonal collar by assembly of adjacent sides of different containers comprising a drum adapted to turn about an axis and carrying several similar plates parallel to the axis of the drum and substantially perpendicular to a radial direction thereof, the plates being regularly spaced around the drum in such a fashion that two successive plates are separated by a given angle, each plate being provided with several devices for individually holding a container, a device for effecting rotary movement of the drum by steps equal to the given angle in such a fashion that the plate on the drum are located always opposite one of several working stations, a first transfer apparatus located at a first working station and adapted to transfer individual containers from a first stock to the holding devices on the plate which is located at the first working station, a grouping device located at a second working station and adapted to attach together at least certain adjacent sides of the collars of certain adjacent containers and, a second transfer device located at a third working station and adapted to transfer containers after grouping to a second stock.

According to an advantageous feature of the invention individual holding devices for the containers on the plates each comprise an elastic membrane designed to co-operate with the internal surface of a container adjacent its collar. The elastic membrane is advantageously in the form of a semi-torus of external diameter normally less than that of the internal surface of the container and being mounted between two discs together with which it defines a chamber; when the chamber is evacuated of the air which it contains, the two discs approach one another and push the membrane outwardly which can then come to bear against the internal surface of a container.

It is advantageous if at least one of the first and second transfer devices comprises a container support table designed to oscillate between a first position for taking the containers and a second position for placing the containers to face the holding devices, the table turning through about 90° between these two positions; the plates can be radially movable in order that the plate which is located at the first working station can move away from the axis of the drum and locate its holding devices in the containers. For example, the table of the transfer device can be mounted on movable rods each located in a plane perpendicular to the axis of the drum; these rods are fixed to a guide shaft parallel to the axis of the drum the displacement of which is guided by means of a cam surface formed in a plane perpendicular to the axis of the drum. The rods can additionally slide in a pivoting shaft parallel to the axis of the drum, the oscillation of the table being actuated by a second driven pivoting shaft from which extends an arm movable in a plane perpendicular to the axis of the drum, this arm being designed to slide freely in an orifice of the guide shaft but being obliged to turn with the second pivoting shaft.

The grouping device advantageously comprises a plate movable between a position of disengagement from the containers and a working position. This plate may carry several attachment devices which can be individually displaceable between two positions such that, when the grouping device is in its working position, one of the attachment devices ensures attachment of the collars of two adjacent containers together while it is in its first position and does not ensure such attachment when it is in its second position. The attachment devices are for example heat and pressure welding devices, ultrasonic welding devices or adhesive devices.

The stocks of containers can be magazines or conveyors.

In one advantageous embodiment the apparatus comprises four working stations and a code marking device is placed at one of these stations.

The invention also relates to a process for grouping unitary dose containers, each container being terminated by a collar having an exterior polygonal contour, the process being of the type which comprises the assembly of different containers together with two sides of the collars edge to edge. This process comprises the transfer of several individual containers from a stock to a support plate, a displacement of the support plate to face a grouping device, the grouping of at least certain of the containers carried by the plate by attachment together of sides of collars, the displacement of the plate bearing the grouped containers to a discharge position and, the transfer of the grouped containers to a second stock.

Other characteristics and advantages of the invention will emerge better from the description which follows of preferred embodiments which makes reference to the accompanying drawings in which:

DESCRIPTION OF THE DRAWINGS AND PREFERRED EMBODIMENTS

Figures 1, 3:
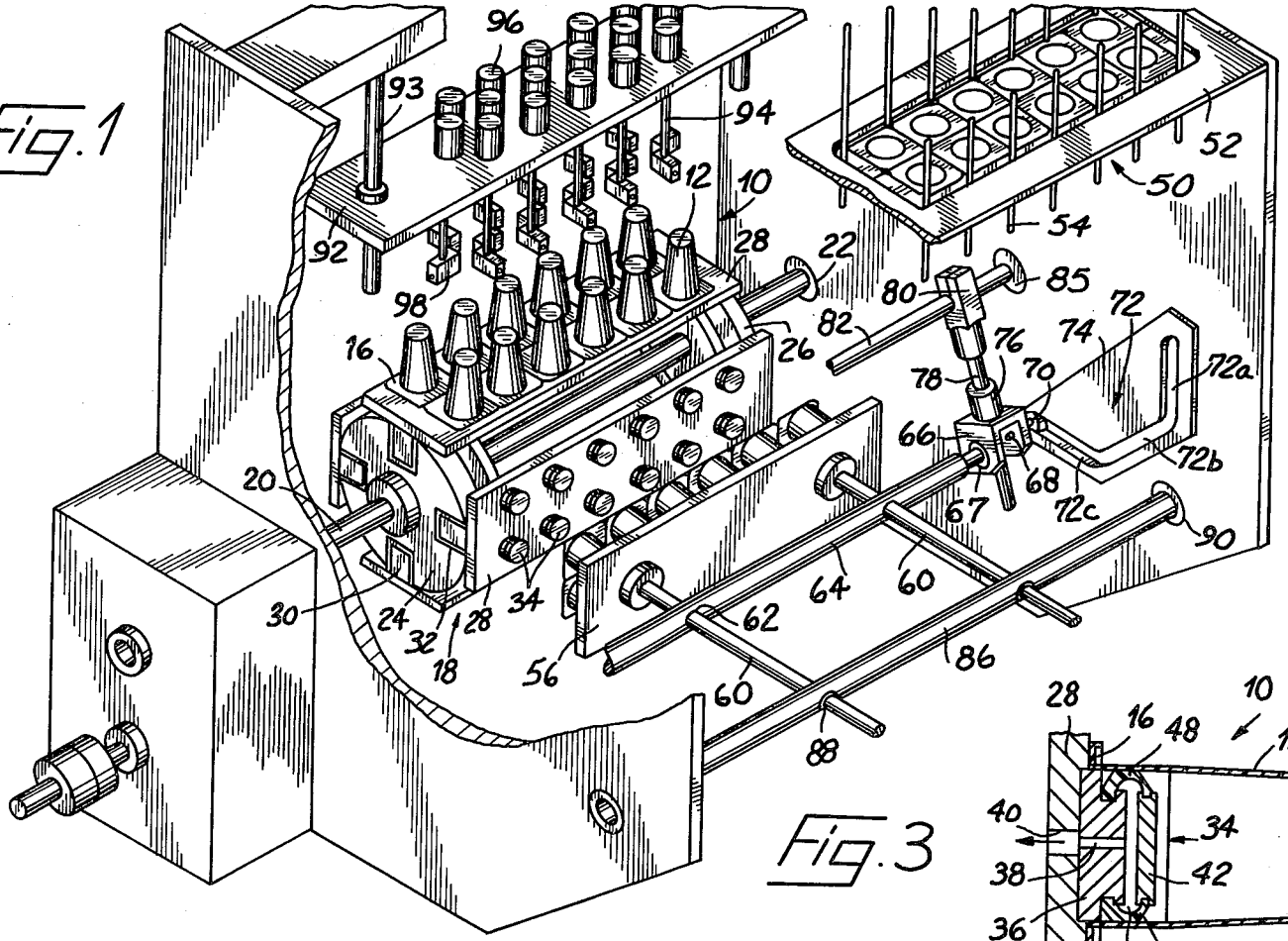
FIG. 1 is a perspective view with parts cut away showing two working stations of an apparatus according to the invention.
FIG. 3 is a section on a larger scale of a holding device for a unitary dose container.

The apparatus according to the invention is designed for grouping unitary dose containers, and in the description which follows the example of a container under consideration is a cup or pot designed to contain yoghurt. Each container as indicated in FIG. 3 carries the general reference number 10 and comprises a body 12 of truncated cone shape closed by a floor 14. At the end opposite the floor the cup is wide open and the opening is surrounded by a rim or collar 16. The collar has a polygonal external shape, square in the particular case as shown on FIG. 1, the corners of the collar being rounded, however.

The apparatus itself will now be considered. The central portion of the apparatus is constituted by a drum 18 mounted on an axle 20. This is driven by a suitable motor and reduction gear, and is rotatably mounted in bearings 22 carried on the framework of the apparatus. The shaft 20 is fixed relative to the drum, for example by a suitable key (not shown).

The drum 18 comprises two discs 24 and 26 at its ends carrying several support plates 28, four in the example under consideration. These plates are disposed at 90° relative to one another, that is to say they are distributed regularly around the circumference of discs 24 and 26. Each plate 28 is fixed to a bar 30 arranged by a rolling ball coupling to slide in grooves 32 which are formed in discs 24 and 26. Cams which are not shown control the radial sliding of bars 30 and accordingly the radial position of plates 28 when these are located at a transfer station as described below with reference to the functioning of the apparatus.

Each plate 28 carries a plurality of mandrels 34 which each constitute holding devices for cups 10. The mandrels are shown in more detail on FIG. 3. From this it can be seen that plate 28 has a recess which contains a disc 36 having a central orifice 38 which communicates with an orifice 40 in plate 28. A second plane disc 42 is located facing the first disc 36, and a membrane 44 in the form of a half torus, as shown on FIG. 3, has its internal edges located in sealed fashion in grooves formed in the two discs 36 and 42. Membrane 44 defines with the two discs a chamber 46. In normal conditions or when compressed air is introduced into chamber 46 the external surface 48 of the membrane has a diameter which is less than or equal to that of the opening of the cup 10. On the other hand when the air contained in chamber 46 is evacuated via the orifices or channels 38 and 40, disc 42 is pulled towards disc 36 in such fashion that the membrane is pushed outwardly and comes to engage the internal surface of the container near the collar by means of its external surface 48. Thus alternating transmission of compressed air or atmospheric pressure and emptying of chamber 46 ensures freeing or holding of the container 10 on the device 34.

As shown in FIG. 1, each plate 28 has a plurality of mandrels 34, twelve in the embodiment shown in FIG. 1.

FIG. 1 also shows a magazine 50 of individual unitary dose containers piled up as shown on FIG. 1 in twelve piles. Any other number may of course be provided depending upon the number of the corresponding mandrels on plates 28. The magazine is formed to lie above an orifice in a plate 52 which carries rods 54 for guiding the piles of containers. This arrangement appears more clearly in FIG. 2. It should be noted that the containers are normally maintained in the magazine by means of a device which holds the lowermost containers.

The transfer device which introduces the containers from the magazine 50 into the apparatus according to the invention will now be considered. This transfer device comprises a table 56 which, as indicated by reference 58 on FIG. 2, comprises a device designed to hold the cups 10. A simple suction head may for example be used. Table 56 is mounted on rods 60 which pass through holes 62 in a guide shaft 64. This guide shaft 64 is parallel to shaft 20 which carries the drum and at least one of its ends is mounted in a branch of a stirrup 66 by means of a bearing 67. The other leg of the stirrup 66 carries an axle 68 aligned with shaft 64 in such a way that in the sense of the present description, the expression guide shaft designates the assembly constituted by shaft 64 and axle 68. This latter carries a roller 70 designed to roll on a cam surface 72 formed on plate 74 fixed to the framework and arranged in a plane perpendicular to drum shaft 20. The stirrup 66 has in its central portion a bearing 76 which permits an arm 78 to slide through it, this arm 78 being fixed by means of a grip member 80 to a driven pivoted shaft 82. This shaft 82 can pivot in bearings 85 fixed on the framework. It is actuated by an entrainment device shown on FIG. 2. A pinion 83 is fixed relative to shaft 82, onto which it is e.g. keyed, and it co-operates with the teeth of a rack 84 which is actuated by the main drive means of the apparatus.

The rods 60 can additionally slide relative to another pivoting shaft 86 in slide bearings 88 located in holes in this shaft. The shaft 86 is rotatably mounted in bearings 90 fixed to the framework.

Figure 2:
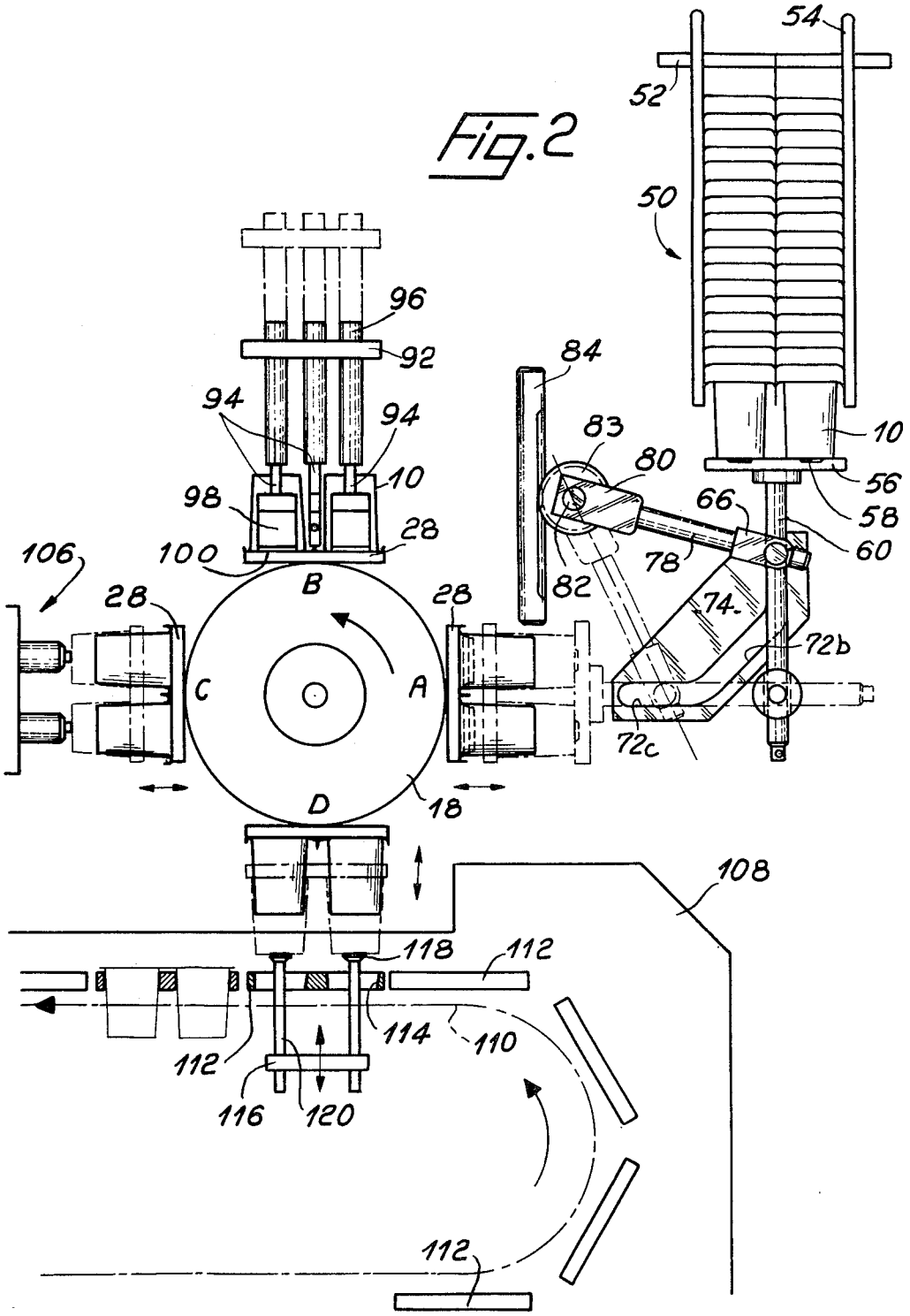
FIG. 2 is a schematic transverse section through the apparatus of FIG. 1.

The functioning of this transfer device is now considered: As indicated in FIG. 2, in an initial position the rack 84 is driven into the position shown in FIG. 2 so that arm 78 has the position drawn in full lines on FIG. 2. In this position the roller 70 is located at the upper end of the cam surface 72 (See FIG. 1)-0- and rods 60 are vertical. Table 56 is then to be found just below the pile of cups 10 in magazine 50. The lowermost cups are then held onto table 56 by suction and rack 84 starts to rise. It turns pinion 83 in the clockwise direction as seen in FIG. 2 so that arm 78 move angularly in the clockwise direction. As roller 70 is displaced into the substantially vertical part **72*a* of the cam surface 72**, guide shaft 64 is lowered in a vertical plane and also lowers the cups 10 which are thus separated from the bottom of the piles in the magazine 50 while a suitable device holds the remaining containers. When the cups 10 are disengaged from the base of the magazine 50, the roller 70 enters into the intermediate part 72*b* of the cam which is inclined in such a fashion that the rods 60 pivot around the axis of shaft 86 and are rotated into a horizontal position as indicated in dashed lines on FIG. 2. The roller 70 then reaches the portion 72*c* of the cam which is substantially horizontal so that the combined rotation of the driven shaft 82 advances table 56 towards the mandrels 34 in a direction perpendicular to plate 28. In this fashion the cups 10 carried by the table 56 come to fit around the mandrels which can then be connected to a vacuum source so that they hold the cups. Suction on table 56 is then suppressed so that the cups remain on the mandrels 34 when table 56 is removed and returned to the position shown in full lines on FIG. 2 by means of a sequence of operations the reverse of that just described.

It should be noted that the horizontal portion of the cam surface 72 permits the displacement of the table 56 with the object that it comes to place the cups on the mandrels 34. This characteristic is not indispensable since, when plates 28 can slide in grooves 32 as indicated above, plate 28 can be made to advance in order to lodge the mandrels 34 into the cups. The apparatus can comprise one and/or the other of these features, although both have been described for the sake of completeness.

With reference to FIGS. 1 and 2 the constitution of the grouping device for the containers will now be considered. This device comprises a plate 92 located above the second working station B (the four work stations of the machine shown are denoted by reference letters A, B, C and D). This plate 92 can run on rods 93, and it carries rods 94 the upper ends of which are fixed to jacks 96 of suitable type. The lower end of each rod 94 carries a welding head 98. These heads are for example heated by heating elements which are connected to a suitable temperature regulator or they can be vibrating devices fed by an ultrasonic emitter for the purpose of effecting ultrasonic welding. It should be noted on FIG. 1 that the device comprises, on the one hand, certain welding heads which are substantially parallel to the axis of shaft 20 of the drum and, on the other hand, other heads oriented substantially perpendicular to this axis. Each head is designed to ensure joining of the collars of two of the adjacent cups 10 carried by plate 28.

The functioning of this grouping device is now considered. When the drum 18 turns, plate 92 is in the upper position so that all of the welding heads are out of the way of the cups 10 carried by plate 28. When the drum has stopped, plate 92 is lowered and the welding or adhering devices carried by the heads 98 effect the attachment of the respective sides of the collars of, in each case, two adjacent cups 10. Then plate 92 rises and the drum can turn a further step.

It should be noted that various types of assembly of containers can be effected on the apparatus. For example FIGS. 5 to 8 show assemblies in twos, threes, fours and sixes respectively. On these figures, reference numerals 102 designate zones in which the sides of the collars are not connected to one another, while reference numerals 104 designate in each case a connection zone connecting the sides of the collars. One thus notes on these FIGS. 5 to 8 that only certain of the heads 98 effect the bonding of two adjacent sides. The jacks 96 permit selection of which heads will perform bonding. In effect, they permit one to raise sufficiently those heads 98 that do not effect attachment since these heads do not come into contact with the collars. In this fashion only certain connections are effected and the assemblies can be of the type wanted, FIGS. 5 to 8 showing only non-limitative examples thereof.

When the drum has turned through another 90° the grouped cups pass from the position B to position C as shown in FIG. 2. It is not necessary that any operation be effected at this work station. However, a printing device 106 has been shown which is designed to mark the base of the cups with an automatic identification code such as that known under the name "Gencod" or any other. This feature is, however, purely optional, this station if desired serving simply to allow cooling of the joints of the collars to take place when heating has been used to join them.

When the drum turns another step the plate 28 passes from station C to station D where the cups should be discharged. In FIG. 2 a machine has been shown which is designed to receive the cups. This machine denoted by reference 108 comprises a chain 110 carrying plates 112 having apertures 114 each permitting a cup to be lodged therein. A device 116 is movable vertically with the object that when it rises it places suction heads 118 carried by rods 120 into contact with the base of the cups 10. Device 116 then descends and thus guides the cups into the apertures 114.

The overall functioning of the apparatus according to the invention is now considered with reference to FIG. 2. One should consider as the initial position that one in which the transfer device occupies the position as shown in full lines on FIG. 2, the grouping device is in its upper position indicated on FIG. 2, the printing device is displaced towards the left as shown on FIG. 2, and the device 116 is lowered beneath plates 112. Drum 18 turns a quarter of a turn. It moves empty mandrels into position A and mandrels carrying cups in the three other positions (B–D). When the drum stops, the devices at the different work stations function simultaneously. The transfer device passes from the position indicated in full lines to the position indicated in broken lines, thereby placing the cups on the mandrels, and returns to the position shown in full lines. The welding device lowers, attaches certain of the collars of the cups together, and rises. The printing device comes into contact with the bottoms of the cups, applies a suitable code and is removed. The second transfer device 116 rises, seizes the cups placed opposite it and descends placing the cups into the apertures 114 and then it frees these cups and moves away downwardly. At this moment the plates 28 in positions A, B and C carry cups while the plate in position D does not carry any of them.

The drum then turns a quarter of a revolution in the counter-clockwise direction as seen in FIG. 2. In this fashion the plate deprived of cups comes to be located at station A. The cycle indicated above then recommences.

Naturally suitable drive means ensure the synchronization of these movements. This drive means comprises in one embodiment of the invention a motor and gear box unit driving a Maltese Cross having four positions which drives the rotation of the drum. The same device controls the displacement by way of translation of rack 84, of plate 92, of impression device 106 if appropriate, and of the second transfer device 116. Such drive devices are well known to persons skilled in the art and do not need to be described here in detail.

Figure 4:
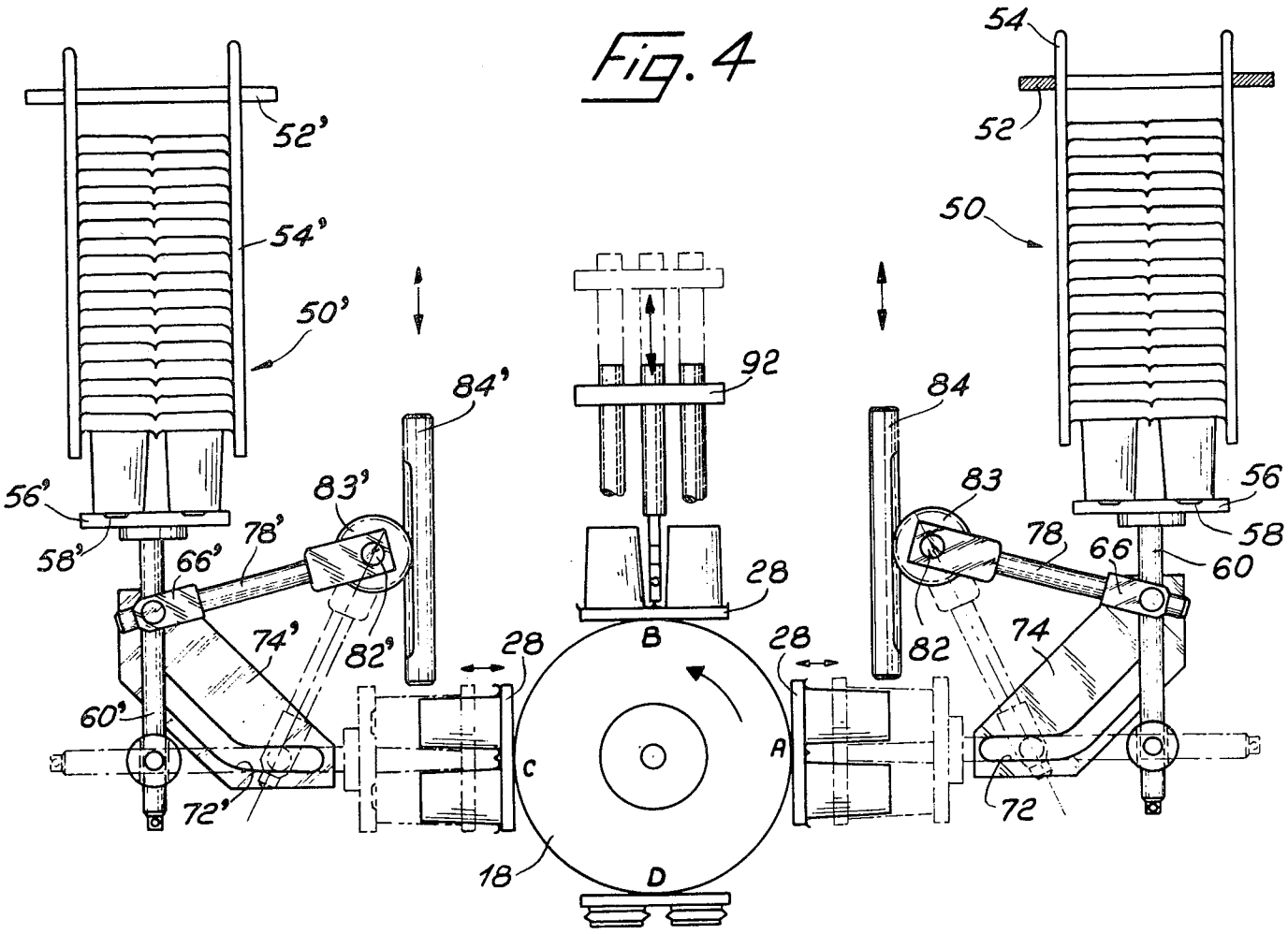
FIG. 4 is a view analogous to that shown in FIG. 2 but showing a variant.
Figure 5:
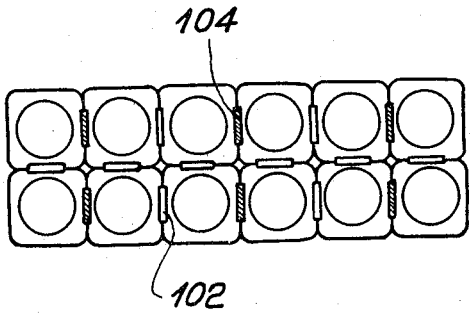
FIGS. 5 to 8 are plan views of containers formed into groups using the apparatus according to the invention.
Figure 6:
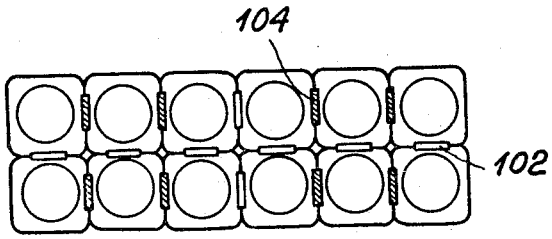
Figure 7:
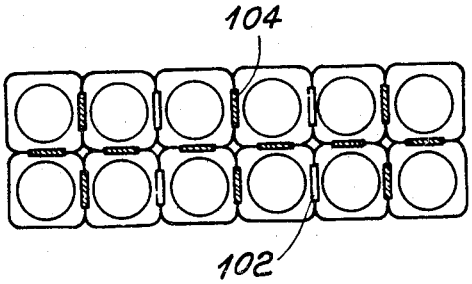
Figure 8:
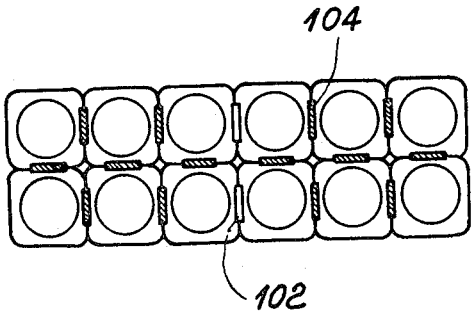

FIG. 4 shows another embodiment in which the only operation effected is the assembly of the sides of the collars so that the second transfer device is placed at station C. This second transfer device is in fact analogous to the first and accordingly it will not be described in detail. The various elements are identified by reference numerals which are identical to those corresponding to the first embodiment, followed by a superscript prime. The functioning is the reverse of that which has been described earlier, the grouped containers being finally piled up one into the other in a magazine 50'. Naturally at station D the mandrels do not carry any cups.

It is to be understood that the invention has been described and shown only by way of preferred embodiment and that any equivalent technical means can be substituted for the constituent elements shown without for that reason departing from the body of the invention. Thus those skilled in the art know numerous types of transfer devices, holding devices, assembly devices and the like which can be used in place of those which have been described in detail above.

We claim:

1. In apparatus for grouping containers each provided with a polygonal collar by attaching together adjacent sides of different containers, the improvement comprising a drum designed to turn about an axis and carrying several similar plates parallel to the axis and substantially perpendicular to a radial plane through the drum, the plates being regularly spaced about the drum in such a way that each two successive plates are separated by a given angle, a plurality of devices located on each plate for releasably engaging and holding each of said containers solely by an internal surface of said container, a plurality of work stations spaced about the drum, a drive device for driving the drum in rotation by steps equal to the given angle in such a fashion that the plates of the drum are always opposite located adjacent one of the work stations, a first transfer device located at a first work station and designed to transfer separate containers from a first stock to holding devices on the plate which is located at the first work station, a grouping device located at a second work station and designed to attach together certain adjacent sides of the collars at least of certain containers, and a second transfer device located at a third work station and designed to transfer the containers after grouping to a second stock.

2. The apparatus of claim 1 wherein at least one of the first and second transfer devices comprises a table for supporting the containers, and means for oscillating the table between a first position for taking containers and a second position for placing containers onto facing holding devices, the table turning through about 90° between these two positions.

3. The apparatus of claim 2 wherein the table of the transfer device is mounted on rods each movable in a plane perpendicular to the axis of the drum, the rods being fixed to a guide shaft parallel to the axis of the drum and the displacement of which is guided by a cam surface located in a plane perpendicular to the axis of the drum, the rods being able in addition to slide in a pivoting shaft parallel to the axis of the drum, the oscillation of the table being effected by a second driven rotatable shaft from which an arm extends movable in a plane perpendicular to the axis of the drum, the said arm being designed to slide directly in an orifice of the guide shaft while it pivots under the actuation of the second pivoting shaft.

4. Apparatus according to claim 1 wherein the grouping device comprises a plate movable between a position disengaged from the containers and a working position, the plate carrying several assembly devices which are individually displaceable between two positions such that when the grouping device is in its working position, an assembly device ensures attachment together of two adjacent containers if in its first position and does not effect such attachment if in its second position.

5. The apparatus of claim 4 wherein that the assembly devices of the grouping device are chosen from the group consisting of heat and compression welding devices, ultrasonic welding devices and adhesion devices.

6. In apparatus for grouping containers each provided with a polygonal collar by attaching together adjacent sides of different containers, the improvement comprising a drum designed to turn about an axis and carrying several similar plates parallel to the axis and substantially perpendicular to a radial plane of the drum, the plates being regularly spaced about the drum in such a way that each two successive plates are separated by a given angle, a plurality of holding devices on each plate for releasably holding individual containers, each holding device comprising an elastic membrane for releasably engaging an internal surface of the container near its collar, a plurality of work stations spaced about the drum, a drive device for driving the drum in rotation by steps equal to the given angle in such a fashion that the plates of the drum are always located opposite one of the work stations, a first transfer device located at a first work station and designed to transfer separate containers from a first stock to holding devices on the plate which is located at the first work station, a grouping device located at a second work station and designed to attach together certain adjacent sides of the collars at least of certain containers, and a second transfer device located at a third work station and designed to transfer the containers after grouping to a second stock.

7. The apparatus of claim 6 wherein the elastic membrane has the form of a semi-torus of diameter normally less than that of the opening of the container and it is mounted between two discs with which it defines a chamber in such a fashion that when the chamber is emptied of air which it contains the two discs approach one another and press outwardly the membrane which can then come to engage against the internal surface of a container.

8. In an apparatus for grouping and joining containers each of which has walls defining inner and outer surfaces and a polygonal collar adjacent the open end of said container, the apparatus operable with first stock means providing a supply of separate containers and second stock means for receiving joined containers from said apparatus, the improvement comprising of a drum rotatable about a central axis and carrying a plurality of plates, each parallel to said axis and substantially perpendicular to a radial plane through said drum, the plates being regularly spaced about the drum such that each two successive plates are separated by a given angle, a plurality of holding devices on each plate, each device comprising means for releasably engaging and holding only inner surfaces of a container near the collar of said container, a plurality of work stations spaced circumferentially about the drum, each station spaced from the next by said given angle or multiple of same, drive means for rotating said drum by steps equal to said given angle such that said plates always stop adjacent one of said work stations, first transfer means at a first of said work stations for transferring a plurality of said separate containers from said first stock means to said holding devices on a plate located at said first work station, grouping and joining means located at a second of said work stations for joining together selected adjacent sides of collars of selected containers, and second transfer means located at a third of said work stations for transferring said joined containers to said second stock means.

9. Apparatus according to claim 8 and operable with suction means for creating a partial vacuum, wherein each of said containers has a predetermined inner first diameter dimension near its collar and each of said holding devices comprises first and second radially spaced apart elements, both having diameter less than said first diameter, and a flexible membrane joining said elements and defining side walls of an enclosed chamber whose normal diameter is also less than said first diameter, duct means connecting said suction means to each of said chambers for selectively creating a partial vacuum therein, which urges said first and second elements toward each other and said membrane to be flexed outward to a diameter greater than said first diameter whereby said membrane, when said holding means is within a container, will be urged against its side walls for releasably engaging and holding same.

10. Apparatus according to claim 9 wherein said containers and said elements are round and said membrane of each holding device defines a semi-torus.

11. In a process for grouping containers, each container being terminated by a collar having an exterior polygonal contour, the process being of a type which comprises assembling adjacent sides of the collars edge to edge of two different containers, the improvement which comprises transferring several individual containers from a stock to one of several support plates carried on a rotary drum, holding the containers on the support plate with means engaging the containers solely by their internal surfaces, rotating the drum such that the support plate lies opposite a grouping device, grouping at least certain of the containers carried by the plate by attaching together said adjacent sides of the collars, rotating the drum such that the plate carrying the grouped containers moves to a discharge position, and discharging the grouped containers to a second stock.

* * * * *